US010300360B2

(12) United States Patent
Hequily

(10) Patent No.: US 10,300,360 B2
(45) Date of Patent: May 28, 2019

(54) DYNAMIC ARTIFICIAL WAVE FACILITY FOR THE PRACTICE OF SURFING

(71) Applicant: Laurent Hequily, La Teste de Buch (FR)

(72) Inventor: Laurent Hequily, La Teste de Buch (FR)

( * ) Notice: Subject to any disclaimer, the term of this patent is extended or adjusted under 35 U.S.C. 154(b) by 0 days.

(21) Appl. No.: 15/747,661

(22) PCT Filed: Jul. 27, 2016

(86) PCT No.: PCT/FR2016/000126

§ 371 (c)(1),
(2) Date: Jan. 25, 2018

(87) PCT Pub. No.: WO2017/017319

PCT Pub. Date: Feb. 2, 2017

(65) Prior Publication Data

US 2018/0214757 A1 Aug. 2, 2018

(30) Foreign Application Priority Data

Jul. 28, 2015 (FR) ..... 1557225

(51) Int. Cl.
*A47K 3/10* (2006.01)
*A63B 69/00* (2006.01)
(Continued)

(52) U.S. Cl.
CPC ..... *A63B 69/0093* (2013.01); *E04H 4/0006* (2013.01); *E04H 4/12* (2013.01);
(Continued)

(58) Field of Classification Search
CPC ..... A63B 69/0093; A63B 2208/03; E04H 4/0006; E04H 4/12; E04H 4/145
(Continued)

(56) References Cited

U.S. PATENT DOCUMENTS 3,913,332 A 10/1975 Forsman
2009/0255047 A1* 10/2009 Malinov ..... E04H 4/0006 4/491

(Continued)

FOREIGN PATENT DOCUMENTS

KR 2009 0109917 A 10/2009
WO 00/05464 A1 10/2000

OTHER PUBLICATIONS

International Search Report, dated Feb. 14, 2017, from corresponding PCT/FR2016/000126 application.

*Primary Examiner* — Huyen Le
(74) *Attorney, Agent, or Firm* — Young & Thompson

(57) ABSTRACT

A disclosed facility includes a wave generator, a support including an edge zone, a culminating zone, a progression zone sloping upwardly between the edge and culminating zones, a crest between the culminating zone and a depressed zone depressed relative to the crest, water situated over the edge and progression zones, forming part of an aquatic environment including horizontally contiguous upper and deep regions which are respectively higher than and lower than the edge zone, and an inner zone over the edge and progression zones and which is vertically contiguous with the upper region; the facility being configured such that the water at end of travel of the waves gets past the crest and falls into a reception volume delimited by the depressed zone when the generator is in use; and a fluidic communication below the support linking the deep region to an opening that is open to the reception volume.

20 Claims, 6 Drawing Sheets

(51) Int. Cl.
*E04H 4/00* (2006.01)
*E04H 4/12* (2006.01)
*E04H 4/14* (2006.01)

(52) U.S. Cl.
CPC ..... *E04H 4/145* (2013.01); *A63B 2208/03* (2013.01); *A63B 2225/60* (2013.01)

(58) Field of Classification Search
USPC ..... 4/491
See application file for complete search history.

(56) References Cited

U.S. PATENT DOCUMENTS

| | | | | |
|---|---|---|---|---|
| 2013/0074254 | A1* | 3/2013 | Payne | E04H 4/0006 4/491 |
| 2014/0000020 | A1* | 1/2014 | von Groll | E04H 4/0006 4/491 |
| 2017/0080348 | A1* | 3/2017 | Mladick | E02B 3/062 |

* cited by examiner

DYNAMIC ARTIFICIAL WAVE FACILITY FOR THE PRACTICE OF SURFING

The invention relates to dynamic artificial wave facilities for the practice of surfing.

It is known that dynamic artificial waves reproduce natural waves that propagate and must not be confused with static artificial waves which are formed by a layer of water of uniform thickness, for example of the order of 10 cm, projected onto a sloping wall.

In the present document, it is intended that the references to artificial waves be understood as being directed to dynamic artificial waves and not static artificial waves.

From U.S. Pat. No. 3,913,332 there is already known an artificial wave facility for the practice of surfing which comprises, in the embodiment illustrated in FIGS. 8 and 9:

- a substrate delimiting a lake, which substrate presents an upper surface comprising an island or raised zone of circular general shape, a horizontal bottom zone and a sloping zone extending between the bottom zone and the raised zone; the substrate also delimiting the outer periphery of the lake;
- water situated within the outer periphery of the lake over the horizontal bottom zone and the sloping zone, the zone of the sloping zone that is closest to the raised zone being emerged;
- an artificial wave generator comprising three water driving members each movable over the horizontal bottom zone in a predetermined circular path situated along the outer periphery of the lake; the wave generator and the upper surface of the substrate being configured such that when the wave generator is in use, the movable members remain angularly equidistant with each mobile member being laterally followed by a wave moving in the water towards the sloping zone in contact with which the wave breaks towards the apex of the sloping portion.

According to a first aspect, the invention is directed to providing a similar facility with good performance in terms of usage capacities and longevity.

To that end the invention provides an artificial wave facility for the practice of surfing, comprising:

- a support having an upper surface comprising an edge zone, a wave progression zone and a culminating zone, the wave progression zone extending, in an upwards slope, from the edge zone to the culminating zone;
- water situated over said edge zone and said wave progression zone;
- an artificial wave generator comprising at least one water driving member movable over the edge zone along a predetermined path, said wave generator and said upper surface of the support being configured such that when the wave generator is at rest the culminating zone is emerged and when the wave generator is in use, the movable member is laterally followed by a wave moving in the water towards the wave progression zone in contact with which the generated wave breaks towards the culminating zone;

characterized in that:

- said water situated over the edge zone and the wave progression zone forms part of an aquatic environment which, externally of the support along the edge zone, comprises a region, hereinafter called upper outer aquatic region, situated higher than the edge zone and a region, hereinafter called deep outer aquatic region, situated lower than the edge zone, the upper outer aquatic region and the deep outer aquatic region being horizontally contiguous;
- the upper outer aquatic region and the region of the aquatic environment situated over said edge zone and said wave progression zone, hereinafter called inner aquatic region, are vertically contiguous;
- the upper surface of the support further comprises a crest and a depressed zone which is depressed relative to the crest, which crest is located between the culminating zone and the depressed zone, the culminating zone and the depressed zone being configured such that when the wave generator is in use, the water at the end of travel of the waves gets past the crest and falls into a volume delimited by the depressed zone, hereinafter called reception volume of the support; and
- fluidic communication situated below the upper surface of the support connects said deep outer aquatic region to an opening which is open to said reception volume of the support.

At least for the most part, a backwash into the inner aquatic region is thus avoided, since the water at the end of travel of the waves leaves the inner aquatic region by falling into the reception volume of the support from which it is evacuated without passing via the inner aquatic region since the fluidic communication is located below the upper surface of the support.

The upper outer aquatic region is not disturbed either, or is disturbed very little, since it is the deep outer aquatic region which is in communication with the reception volume of the support.

As the inner aquatic region, and furthermore the upper outer aquatic region, are not therefore disturbed by the backwash, or whatever the case are very little disturbed, it is possible to have a very short time between two successive waves.

The facility according to the invention thus has good usage capacities.

What is more, the support is acted on mechanically relatively little by the waves since the water is guided to the reception volume from which it naturally goes to join the deep outer aquatic region, due to the mere existence of the fluidic communication.

The facility according to the invention thus has good performance in terms of longevity.

It will be noted that, as for the facility of the embodiment illustrated in FIGS. 8 and 9 of U.S. Pat. No. 3,913,332, in the facility according to the invention the waves only break on one side of the wave generator.

Indeed, in the facility according to the invention, the waves only break on the same side as the support. No wave can break on the other side, which is only occupied by the deep outer aquatic region and by the upper outer aquatic region which are horizontally contiguous.

It will furthermore be noted that it is to be clearly understood that the subdivision of the aquatic environment into different aquatic regions is solely based on the location of the regions in question relative to the support, that is to say that the aquatic regions designate locations at which water is to be found and not isolated volumes of water.

In particular, there are no liquid-tight walls isolating the different aquatic regions from each other. On the contrary, the water of the aquatic environment flows between the different aquatic regions. Thus, when the wave generator is at rest, the entire aquatic environment has the same surface level. For example, when the wave generator is at rest, the surface level of the inner aquatic region is identical to the surface level of the upper outer aquatic region.

According to advantageous features, said support is a platform; said aquatic environment comprises, under the platform, a region hereinafter called underlying aquatic region, the deep outer aquatic region and the underlying aquatic region being vertically contiguous; and said opening that is open to the reception volume of the support is open to the underlying aquatic region, said fluidic communication situated below the upper surface of the support being implemented by the underlying aquatic region.

It is thus over the platform that the water is in movement when the wave generator is in use, and not over the bottom of the aquatic environment as is the case in the facility described by U.S. Pat. No. 3,913,332.

It is thereby avoided to put into suspension the sediments, alluvium and the like that are generally present on the bottom of an aquatic environment.

More generally, the disturbance caused by the facility to the underlying aquatic region is minimal since there is merely a flow of water to maintain the reception volume of the platform at constant level, which takes place naturally in accordance with the principle of communicating vessels.

According to a second aspect, the invention is directed to a facility that minimizes the disturbance caused to the aquatic environment.

To that end the invention provides an artificial wave facility for the practice of surfing, comprising:

- a support having an upper surface comprising an edge zone, a wave progression zone and a culminating zone, the wave progression zone extending, in an upwards slope, from the edge zone to the culminating zone;
- water situated over said edge zone and said wave progression zone;
- an artificial wave generator comprising at least one water driving member movable over the edge zone along a predetermined path, said wave generator and said upper surface of the support being configured such that when the wave generator is at rest the culminating zone is emerged and when the wave generator is in use, the movable member is laterally followed by a wave moving in the water towards the wave progression zone in contact with which the generated wave breaks towards the culminating zone;

characterized in that:

- said water situated over the edge zone and the wave progression zone forms part of an aquatic environment which, externally of the support along the edge zone, comprises a region, hereinafter called upper outer aquatic region, situated higher than the edge zone and a region, hereinafter called deep outer aquatic region, situated lower than the edge zone, the upper outer aquatic region and the deep outer aquatic region being horizontally contiguous;
- the upper outer aquatic region and the region of the aquatic environment situated over said edge zone and said wave progression zone, hereinafter called inner aquatic region, are vertically contiguous;
- said support is a platform; and
- said aquatic environment comprises, under the platform, a region hereinafter called underlying aquatic region, the deep outer aquatic region and the underlying aquatic region being vertically contiguous.

It is thus over the platform that the water is in movement when the wave generator is in use, and not over the bottom of the aquatic environment as is the case in the facility described by U.S. Pat. No. 3,913,332.

It is thereby avoided to put into suspension the sediments, alluvium and the like that are generally present on the bottom of an aquatic environment.

According to advantageous features of implementation:

- said platform is a floating platform; and optionally
- said platform comprises an opening in which is disposed a pile fastened on the bottom of the underlying aquatic region, the platform and the pile being configured for the platform to slide relative to the pile when changes occur in the surface level of the aquatic environment.

Alternatively, said support is a substrate in which is provided at least one pipe to perform said fluidic communication situated below the upper surface of the support.

This embodiment is particularly well-adapted when the aquatic environment is treated water, for example swimming-pool water.

According to advantageous features of the facility according to the invention, said path of said movable member is annular, said edge zone is situated at the periphery of the support and said culminating zone is situated towards the center of the support.

The support thus forms an island within the aquatic environment.

The annular character of the path of the movable member enables continuous operation of the wave generator.

This annular character also enables the facility to be particularly com pact.

According to other advantageous features, the facility further comprises a groin connected to said support, said groin projecting upwardly from the wave progression zone while extending crosswise of the inner aquatic region from the culminating zone towards the edge zone.

The groin interrupts possible water currents turning around the culminating zone which may form when the wave generator is in use.

According to a third aspect, the invention is directed to providing a compact facility with good performance in terms of usage capacities.

To that end the invention provides an artificial wave facility for the practice of surfing, comprising:

- a support having an upper surface comprising an edge zone, a wave progression zone and a culminating zone, the wave progression zone extending, in an upwards slope, from the edge zone to the culminating zone;
- water situated over said edge zone and said wave progression zone;
- an artificial wave generator comprising at least one water driving member movable over the edge zone along a predetermined path, said wave generator and said upper surface of the support being configured such that when the wave generator is at rest the culminating zone is emerged and when the wave generator is in use, the movable member is laterally followed by a wave moving in the water towards the wave progression zone in contact with which the generated wave breaks towards the culminating zone; said path of said movable member being annular, said edge zone being situated at the periphery of the support and said culminating zone being situated towards the center of the support;

characterized in that said facility further comprises a groin connected to said support, said groin projecting upwardly from the wave progression zone while extending crosswise of the region situated over said edge zone and said wave progression zone from the culminating zone towards the edge zone.

The support thus forms an island within the aquatic environment.

The annular character of the path of the movable member enables continuous operation of the wave generator.

This annular character also enables the facility to be particularly com pact.

The groin interrupts water currents that may be present turning around the culminating which may form when the wave generator is in use.

It is possible to have a very short time between two successive waves.

The facility according to the invention thus has good usage capacities.

According to advantageous features of implementation:

said groin has an upper surface comprising a first lateral zone, a second lateral zone situated on the opposite side to the first lateral zone and an intermediate zone extending from the first lateral zone to the second lateral zone, said intermediate zone comprising at least one crest that is emerged when the wave generator is at rest;

said intermediate zone comprises a first crest and a second crest, each of which is emerged when the wave generator is at rest, and comprises a depressed zone which is depressed relative to the first crest and the second crest, the first crest being located between the first lateral zone and the depressed zone, the second crest being located between the second lateral zone and the depressed zone; the first crest, the second crest and the depressed zone being configured such that when the wave generator is in use, the water at the end of travel of the waves gets past the first crest or the second crest and falls into a volume delimited by the depressed zone hereinafter called reception volume of the groin; said water situated over the edge zone and the wave progression zone forms part of an aquatic environment which, externally of the support along the edge zone, comprises a region, hereinafter called upper outer aquatic region, situated higher than the edge zone and a region, hereinafter called deep outer aquatic region, situated lower than the edge zone, the upper outer aquatic region and the deep outer aquatic region being horizontally contiguous; fluidic communication linking said reception volume of the groin to said upper outer aquatic region and/or to said deep outer aquatic region; and/or said upper surface of the support further comprises a crest and a depressed zone which is depressed relative to the crest, which crest is located between the culminating zone and the depressed zone, the culminating zone and the depressed zone being configured such that when the wave generator is in use, the water at the end of travel of the waves gets past the crest and falls into a volume delimited by the depressed zone, hereinafter called reception volume of the support; and said reception volume of the support and said reception volume of the groin meet vertically.

The disclosure of the invention will now be continued with the detailed description of embodiments, given below by way of non-limiting illustration, with reference to the appended drawings. In these:

Figure 1:
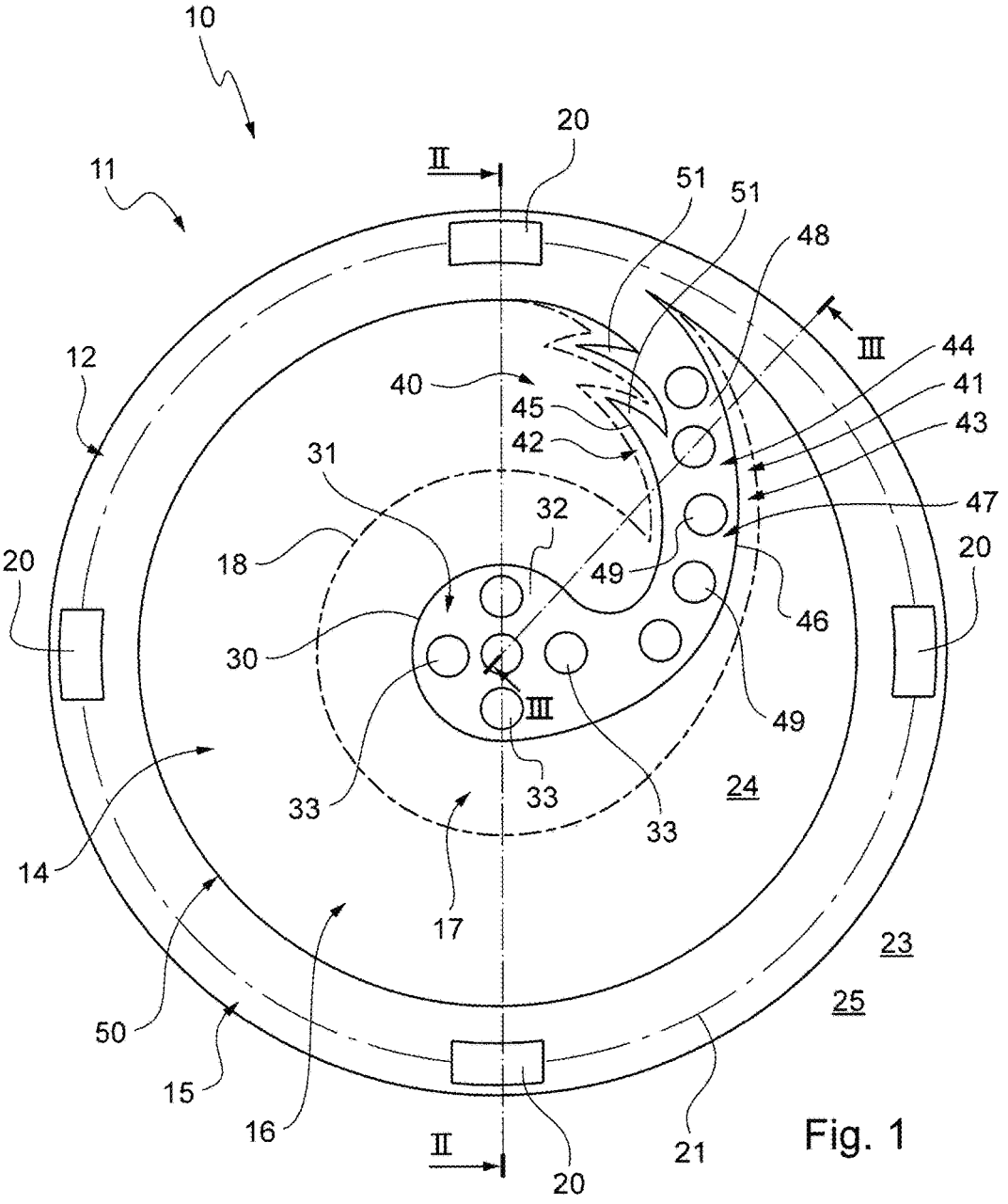
FIG. 1 is a view from above of a facility according to the invention of which the artificial wave generator is at rest.

The facility 10 illustrated in FIGS. 1 to 5 comprises a floating platform 11, here with a circular outer contour and an artificial wave generator 12 installed on the platform 11.

The platform 11 has an upper surface 14 comprising an edge zone 15, a wave progression zone 16 and a culminating zone 17.

The artificial wave generator 12 comprises four water drive members 20, each movable along a predetermined path 21, which is circular here.

Each mobile member 20 moves over the edge zone 15.

The facility 10 is situated in a body of calm water, with no or very little disturbance such as natural waves. The shore of the body of water is at a distance from the facility 10, which thus forms an island.

When the wave generator 12 is at rest, that is to say when the movable members 20 are fixed, the culminating zone 17 is emerged.

Figure 4:
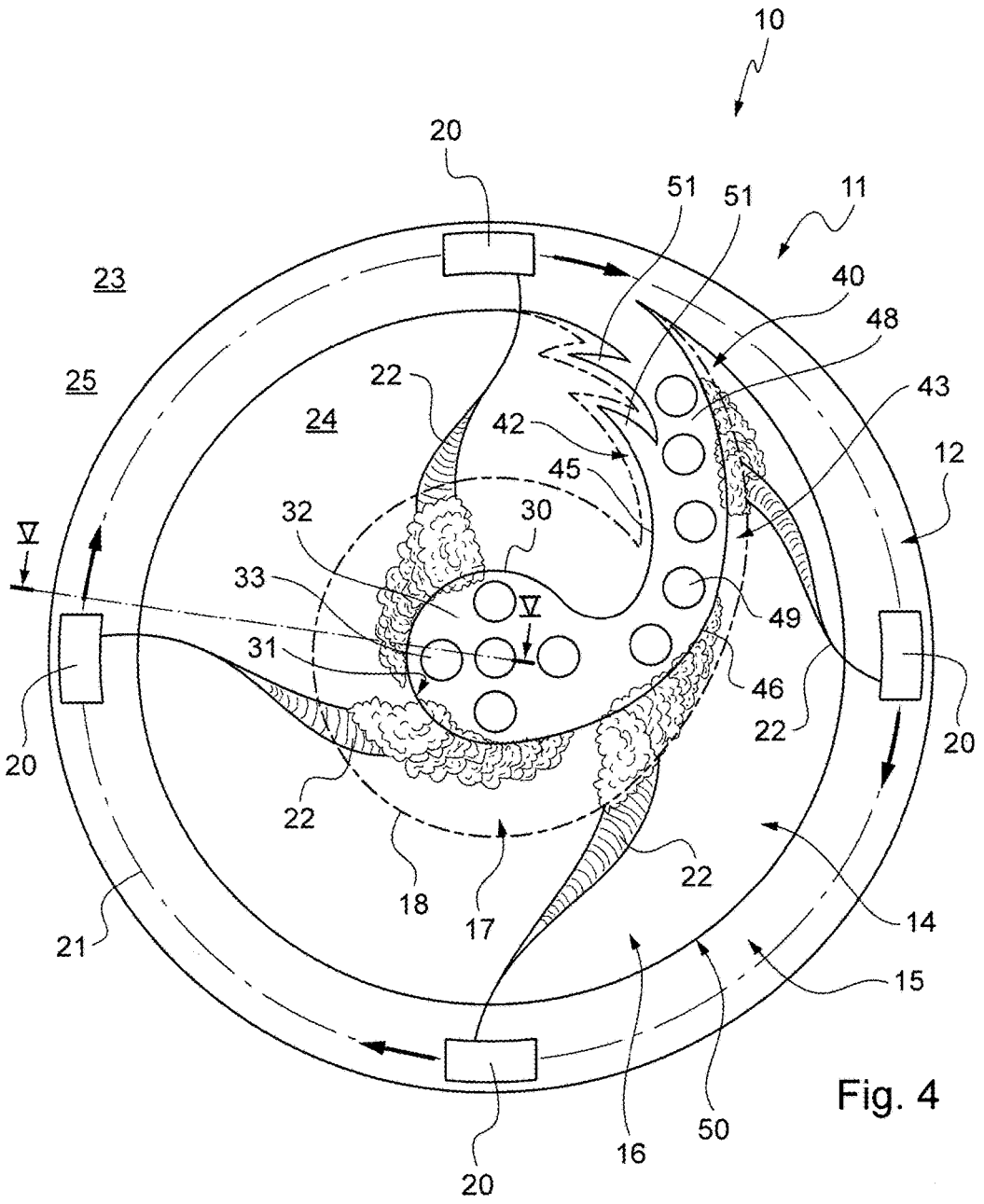
FIG. 4 is a view similar to FIG. 1 but with the artificial wave generator in use.

In FIGS. 1 and 4, the limit between the zones that are emerged and immersed when the wave generator is at rest, is represented by a line 18 of mixed dashes.

When the wave generator 12 is in use, each mobile member 20 is laterally followed, as can be seen in FIG. 4, by a wave 22 moving towards the wave progression zone 16, in contact with which the wave 22 generated breaks towards the culminating zone 17.

The platform 11 for example has a diameter of 60 to 80 m or even more and the waves 22 have a height of the order of 2 m for the practice of traditional surfing (surfer standing on a board); while for the practice of surfing lying on an appropriate board (bodyboard), the facility for example has a diameter of 18 to 22 m or more and the waves 22 have a height of the order of 50 to 60 cm.

Here, the body of water is formed by a sheltered maritime bay or cove.

As a variant, the maritime bay or cove is replaced by another body of water in a natural environment, for example a lake or a river if there is not too much current, or in an artificial setting, for example a pond of masonry.

The aquatic environment 23 (here, the sea) with which cooperate the platform 11 and the wave generator 12 comprises a region 24, called inner aquatic region, situated over the edge zone 15 and the wave progression zone 16.

In addition to the inner aquatic region 24, the aquatic environment 23 comprises, outside the platform 11 along the edge zone 15, a region 25, called upper outer aquatic region, situated higher than the edge zone 15 and a region 26, called deep outer aquatic region, situated lower than the edge zone 15.

The aquatic environment 23 lastly comprises, under the platform 11, a region 27, called underlying aquatic region.

The deep outer aquatic region 26 and the upper outer aquatic region 25 are horizontally contiguous.

The inner aquatic region 24 and the upper outer aquatic region 25 are vertically contiguous.

Similarly, the underlying aquatic region 27 and the deep outer aquatic region 26 are vertically contiguous.

It is to be clearly understood that the subdivision of the aquatic environment 23 into aquatic regions 24 to 27 is solely based on the location of the regions in question relative to the platform 11, that is to say that the regions 24 to 27 designate locations at which water is to be found and not isolated volumes of water.

It will be noted in this connection that there are no liquid-tight walls isolating the different aquatic regions 24 to 27 from each other.

On the contrary, the water of the aquatic environment 23 (here sea water) flows between the different aquatic regions 24 to 27.

Thus, when the wave generator 12 is at rest, the entire aquatic environment 23 has the same surface level.

Figure 2:
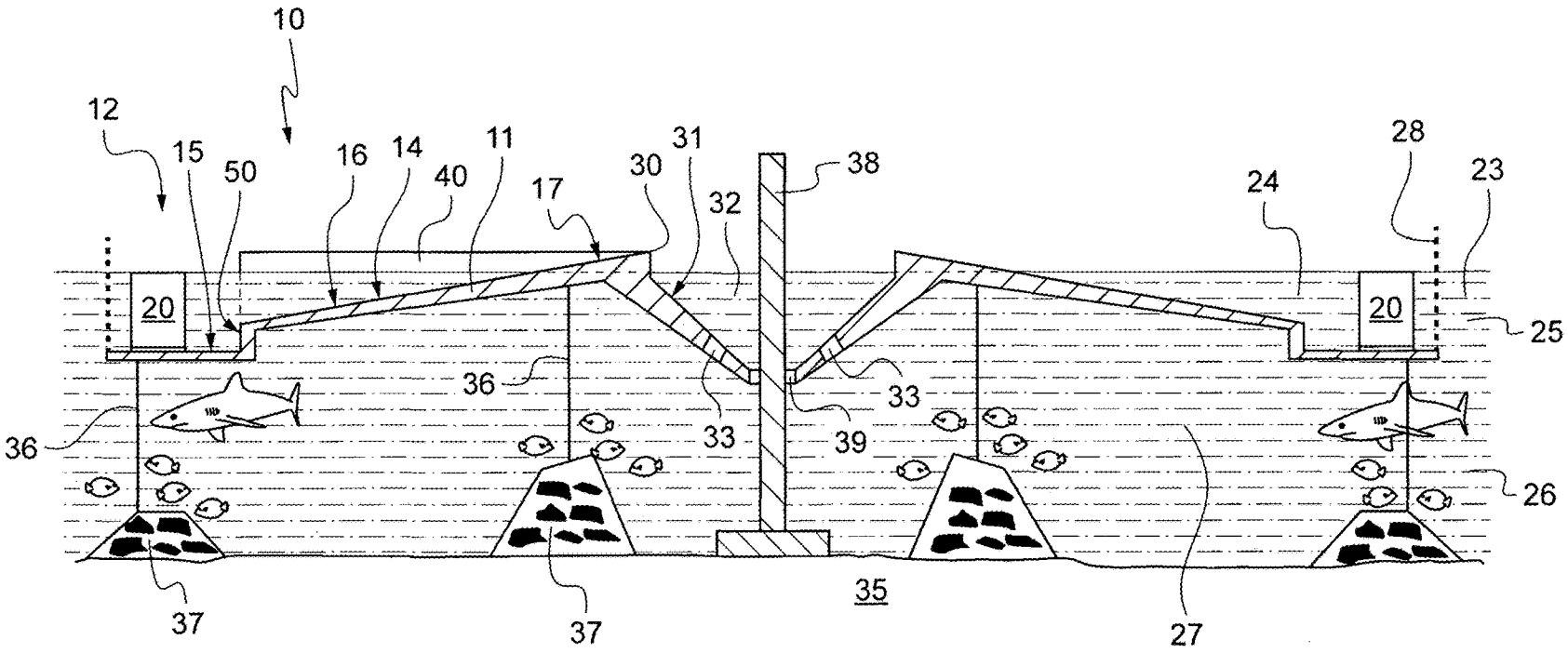
FIGS. 2 and 3 are cross section views respectively on II-II and III-Ill in FIG. 1.
Figure 3:
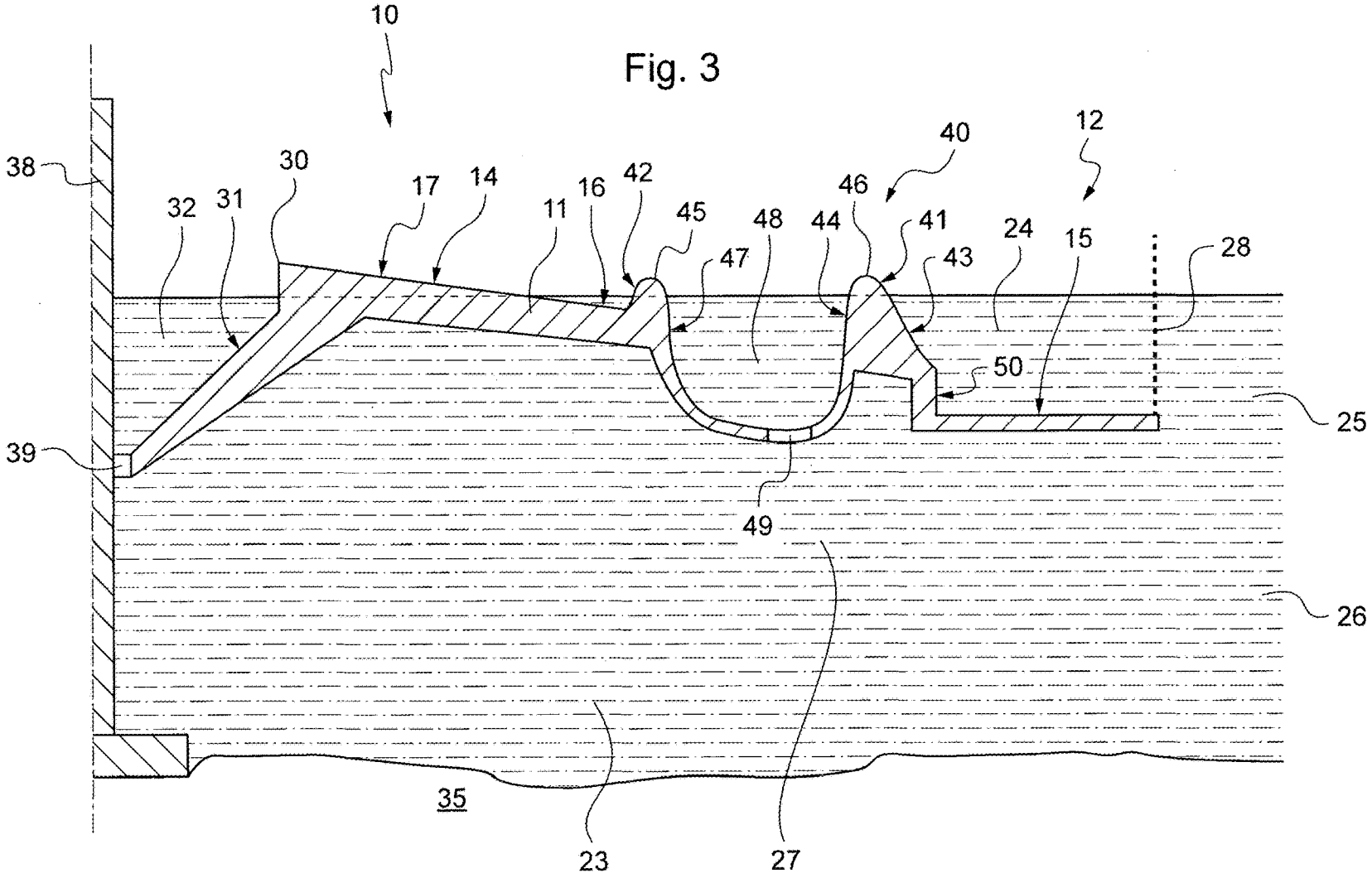

In particular, as can be clearly seen in FIGS. 1 to 3, the surface level of the inner aquatic region 24 is identical to the surface level of the upper outer aquatic region 25.

To protect the surfers against possible marine predators, a grid or net 28 may be provided (shown diagrammatically only on FIGS. 2, 3 and 5) between the inner aquatic region 24 and the upper outer aquatic region 25. Similarly, a grid or a net (not shown) may be provided around the path 21 to avoid any contact between the movable members 20 and the surfers.

The upper surface 14 of the platform 11 comprises, in addition to the edge zone 15, the wave progression zone 16 and the culminating zone 17, a crest 30 and a depressed zone 31 depressed relative to the crest 30.

The crest 30 is located between the culminating zone 17 and the depressed zone 31. More specifically, the crest 30 is located between the apex of the culminating zone 17 and the apex of the depressed zone 31.

Figure 5:
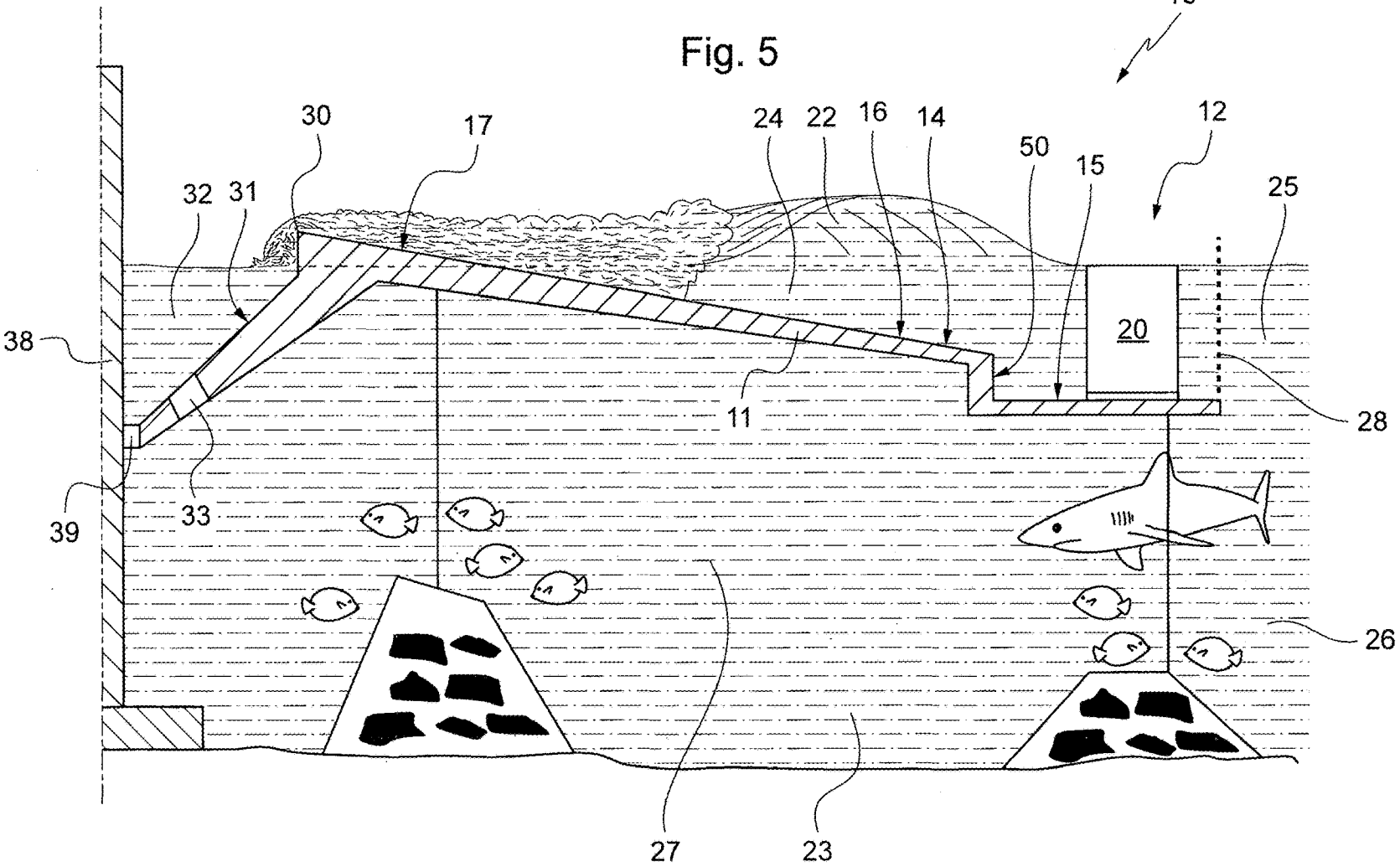
FIG. 5 is the cross-section view on V-V of FIG. 4.

As can be clearly seen in FIGS. 4 and 5, the culminating zone 17 and the depressed zone 31 are configured such that when the wave generator 12 is in use, the water at the end of travel of the waves 22 gets past the crest 30 and falls into a volume 32 delimited by the depressed zone 31, this volume being called reception volume.

Openings 33 or 39 formed through the platform 11 are respectively open to the reception volume 32 and to the underlying aquatic region 27.

The underlying aquatic region 27 provide fluidic communication linking the deep outer aquatic region 26 to the openings 33 or 39, and thus to the reception volume 32.

As can be clearly seen in FIGS. 2 and 3, this results in the surface level of the reception volume 32 remaining the same as for the whole of the aquatic environment 23 when the wave generator 12 is at rest or, as can be clearly seen in FIG. 5, the same as for the aquatic environment 23 outside the inner aquatic region 24 when the wave generator 12 is in use.

Thus, when the wave generator 12 is in use, the water at the end of travel of the waves 22 leaves the inner aquatic region 24 by falling into the reception volume 32 from which it is evacuated without passing by the inner aquatic region 24 since the fluidic communication is situated below the platform 11.

The upper outer aquatic region 25 is not disturbed either, or is disturbed very little, since it is the deep outer aquatic region 26 which is in communication with the reception volume 32.

As the inner aquatic region 24, and furthermore the upper outer aquatic region 25, are not therefore disturbed by the backwash, or whatever the case are very little disturbed, it is possible to have a very short time between two successive waves 22.

What is more, the platform 11 is acted on mechanically relatively little by the waves 22 since the water is guided towards the reception volume 32 from which it naturally goes to join the underlying aquatic region 27 which communicates with the deep outer aquatic region 26.

An explanation will now be given of how the platform 11, which is a floating platform as indicated above, is held in place in the aquatic environment 23.

In general terms, the capacity to float of the platform 11 is provided in order for the edge zone 15 to be at a predetermined distance below the surface level of the aquatic environment 23.

This predetermined distance is that which is appropriate for the proper operation of the wave generator 12.

To hold the platform 11 in relation to the bottom 35 of the aquatic environment 23, links 36 such as chains are provided between the platform 11 and moorings 37 placed on the bottom 35.

A pile 38 is also provided which is fastened to the bottom 35 and engaged in a central opening 39 of the platform 11.

When changes in surface level of the platform occur due to the tide, the platform 11 slides relative to the pile 38 and the links 36 retain the platform 11, in particular to avoid it turning around the pile 38.

As a variant, the platform 11 is held differently in relation to the bottom 35, for example solely with links such as 36 or solely with piles such as 38.

Here, the platform 11 is manufactured from composite materials in the manner of the hull wall of a boat.

As a variant, the composite materials are replaced by other materials used for the manufacture of boat hulls, for example aluminum or wood.

To adjust the capacity to float of the platform 11, chambers (not shown) may be provided, which can be filled to a greater or lesser extent with water.

In normal use, the chambers are filled to adjust the capacity to float as has just been indicated, that is to say in order for the edge zone 15 to be at the desired predetermined distance below the surface level of the aquatic environment.

If it is desired for the platform 11 to emerge more, for example for maintenance operations, the chambers are emptied.

If it is desired for the platform 11 to sink down further, for example to rest on the bottom 35 in case of a storm, the tanks are filled.

As a variant, the platform 11 is not a floating platform but is for example supported by pylons fastened to the bottom 35.

In addition to the platform 11 and the wave generator 12, the facility 10 comprises a groin 40 connected to the platform 11.

The groin 40 projects upwards from the wave progression zone 16 while extending through the inner aquatic region 24 from the culminating zone 17 towards the edge zone 15.

The groin 40 has an upper surface 41 comprising a first lateral zone 42, a second lateral zone 43 situated on the opposite side to the first lateral zone 42 and an intermediate zone 44 extending from the first lateral zone 42 to the second lateral zone 43.

Here, the intermediate zone 44 comprises a first crest 45 and a second crest 46, each being emerged when the wave generator 12 is at rest.

The intermediate zone 44 also comprises a depressed zone 47 which is depressed relative to the first crest 45 and the second crest 46, the first crest 45 being located between the first lateral zone 42 and the depressed zone 47, the second crest 46 being located between the second lateral zone 43 and the depressed zone 47.

More specifically, the first crest 45 is located between the apex of the first lateral zone 42 and one of the two apexes of the depressed zone 47; and the second crest 46 is located between the apex of the second lateral zone 43 and the apex the depressed zone 47.

The first crest 45, the second crest 46 and the depressed zone 47 are configured such that when the wave generator 12 is in use, the water at the end of travel of the waves 22 gets past the first crest 45 or the second crest 46 and falls into a volume 48 delimited by the depressed zone 47, hereinafter called reception volume.

Here, the reception volume 48 of the groin 40 and the reception volume 32 of the platform 11 are vertically contiguous.

More specifically here, as can be clearly seen in FIGS. 1 to 3, the depressed zone 47 which delimits the reception volume 48 has a U-shaped profile and the depressed zone 31 which delimits the reception volume 32 is of frusto-conical general shape with an interruption at the groin 40. The depressed zones 31 and 47 are connected at the location of the interruption.

The crest 30 of the platform 11 is connected at one end to the first crest 45 of the groin 40 and connects at the other end to the second crest 46 of the groin 40.

On the opposite side to that at which it connects to the reception volume 32, the reception volume 48 is open here at the location of the junction between the wave progression zone 16 and the edge zone 15.

The reception volume 48 is thus in fluidic communication with the upper outer aquatic region 25 via the part of the inner aquatic region 24 which is situated over the edge zone 15.

Openings 49, similar to the openings 33, are formed through the lowest part of the wall which form the depressed zone 47. The openings 49 are respectively open to the reception volume 48 and to the underlying aquatic region 27.

The reception volume 48 is thus in fluidic communication, via the underlying aquatic region 27, with the deep outer aquatic region 26.

The water at the end of travel of the waves that has fallen into the reception volume 48 is thus evacuated towards the deep outer aquatic region 26 and/or the upper outer aquatic region 25.

The reception volume 48, on account of the fact that it joins the reception volume 32, is able to participate in the evacuation of the water that has fallen into the reception volume 32.

The connection between the platform 11 and the groin 40 is created here due to the platform 11 and the groin 40 being a single part, the platform 11 and the groin 40 being manufactured conjointly from composite materials in the manner of a boat hull wall.

As a variant, the composite materials are replaced by other materials used for the manufacture of boat hulls, for example aluminum or wood.

As a variant, the groin 40 is a part added onto the platform 11.

The wave generator 12 comprises, as indicated above, four water drive members 20, each movable along the predetermined path 21, which is circular here.

Each movable member 20 moves over the edge zone 15, in the direction shown by arrows in FIG. 4, while driving water towards the wave progression zone 16.

More specifically, each movable member 20 is laterally followed by a wave 22 moving towards the wave progression zone 16. On contact with the wave progression zone 16, the wave 22 breaks towards the culminating zone 17.

The movable members 20 are disposed on the path 21 while being angularly equidistant.

As artificial wave generators are well-known, the generator 12 will not be further described here.

For more detail, reference may be made in particular to U.S. Pat. No. 3,913,332.

It will be noted that it is possible to shape the movable members 20 in order for them also to generate waves by moving in the opposite direction to that illustrated in FIG. 4.

The facility according to the invention thus gives surfers the possibility of traveling on waves to the right or on waves to the left, according to the direction of movement of the movable members 20.

The upper surface 14 of the platform 11 here comprises, between the edge zone 15, which is horizontal, and the wave progression zone 16, which is inclined, a shoulder zone 50 which is vertical or substantially vertical.

The shoulder zone 50 creates an obstacle to the propagation of the water which has been made to move by the movable member 20, which promotes the quality, for the practice of surfing, of the wave generated before it breaks on the wave progression zone 16.

The groin 40, which is disposed across the inner aquatic region 24, enables a possible current of water turning around the culminating zone 17 to be interrupted.

It will be noted in particular that the waves 22 are stopped by the groin 40; and that after the mobile member 20 has got past the groin 40 a new wave 22 begins in calm water or in any event which has not been disturbed by the previous wave 22.

The presence of the upper outer aquatic region 25 also promotes the limitation of currents in the inner aquatic region 24.

As a variant, the groin is employed in a facility in which there is no outer aquatic region.

To avoid backwash as much as possible, the first lateral zone 42 of the groin 40, which is that acted upon most by the waves 22 since the movable members 20 turn in the direction in which they approach that lateral zone, is provided with spits 51.

As explained above, the groin 40 also serves for the evacuation of the water at the end of travel of the waves.

To avoid the movable members 20 causing water to enter the reception volume 48, appropriate measures are employed, for example a shutter which closes the opening towards the outside of the reception volume 48 when the movable member 20 passes in front, or the path 21 is configured in order for the movable members 20 to pass over the surface of the water at that location.

As a variant, the groin 40 does not comprise any reception volume 48, for example by having the intermediate zone 44 of its upper surface 41 replaced by a simple crest.

In another variant not shown, the facility 10 does not comprise a groin such as the groin 40.

A description will now be given of a variant of the facility 10 with reference to FIG. 6,.

For convenience, for similar parts, the same numerical references have been kept as for the facility 10 illustrated in FIGS. 1 to 5.

Figure 6:
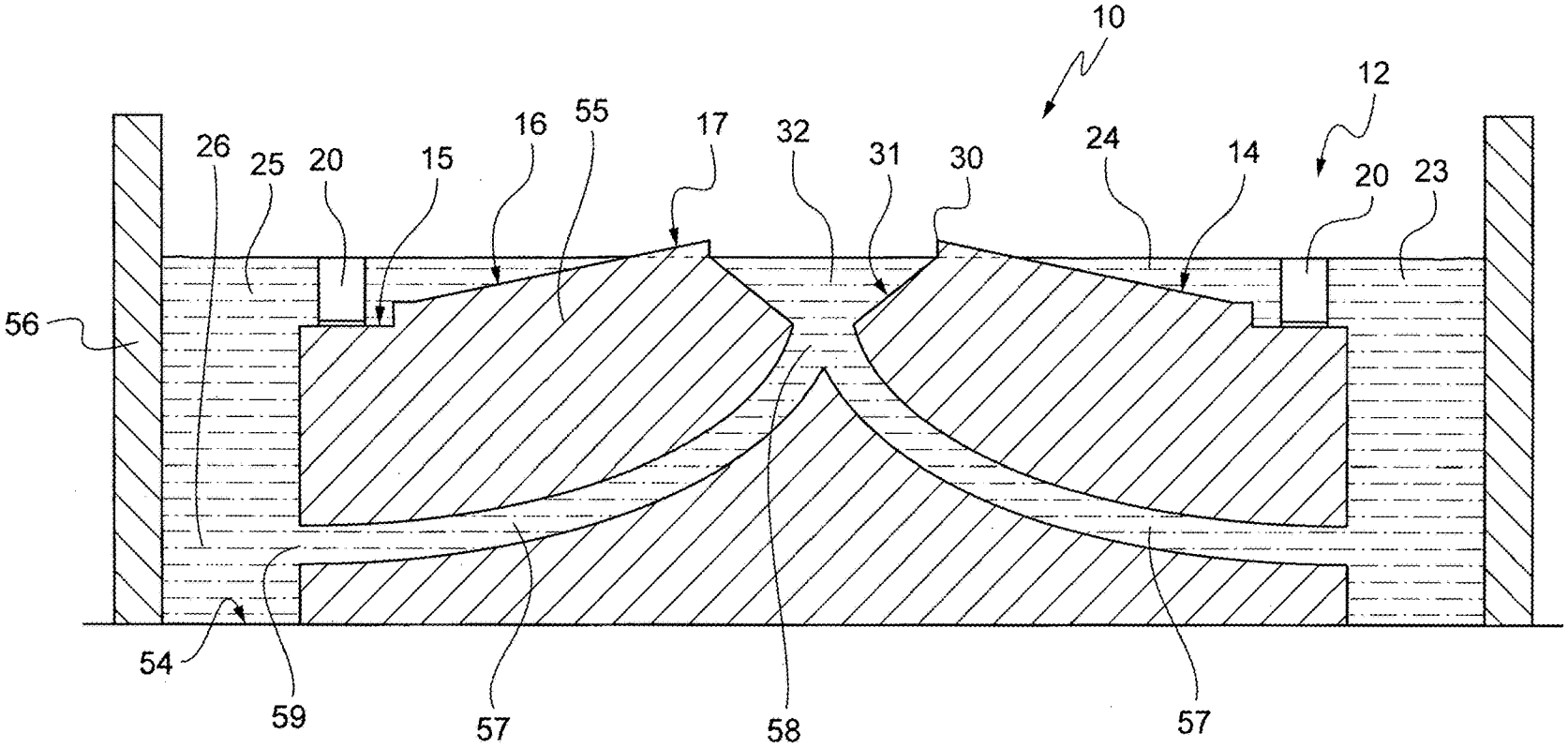
FIG. 6 is a similar view to FIG. 2 for a variant of the facility according to the invention.

In general terms, the facility 10 illustrated in FIG. 6 is similar to the facility 10 illustrated in FIGS. 1 to 5, apart from the fact that the support which provides the upper surface 14 is not a platform situated over an underlying aquatic region but a substrate 55 forming part of the ground and surrounded by an annular pond 56 of which the bottom surface 54 is much lower than the edge zone 15; and the fact that the water of the aquatic environment 23 is treated water, in this case swimming-pool water.

To implement the fluidic communication situated below the upper surface 14 of the support formed by the substrate 55, pipes 57 are formed in the substrate 55. Each pipe 57 opens at one end, by an opening 58, into the reception volume 32 of the substrate 55 and, at the other end, by an opening 59, into the deep aquatic region 26.

Here, the substrate 55 and the annular pond 56 are formed by a structure of masonry.

In variants that are not represented:

the number of mobile members such as 20 of the wave generator such as 12 is different from four, for example only one, two, three or more than four;

an emerged island is provided in the center of the reception volume such as 32 of the support such as the platform 11 or the substrate 55, for example an island on which are disposed buildings;

the path such as 21 of the mobile member or members 20, and thus the contour of the support such as the platform 11 or the substrate 55 is annular without being circular, for example oval, oblong and/or with undulations; or for instance this path is not annular, but for example straight or curved.

Numerous other variants are possible according to circumstances, and in this connection it is to be noted that the invention is not limited to the examples described and shown.

The invention claimed is:

1. An artificial wave facility for the practice of surfing, comprising:

a support (11;55) having an upper surface (14) comprising an edge zone (15), a wave progression zone (16) and a culminating zone (17), the wave progression zone (16) extending, in an upwards slope, from the edge zone (15) to the culminating zone (17);

water situated over said edge zone (15) and said wave progression zone (16);

an artificial wave generator (12) comprising at least one water driving member (20) movable over the edge zone (15) along a predetermined path (21), said wave generator (12) and said upper surface (14) of the support (11;55) being configured such that when the wave generator (12) is at rest the culminating zone (17) is emerged and when the wave generator (12) is in use, the movable member (20) is laterally followed by a wave (22) moving in the water towards the wave progression zone (16) in contact with which the generated wave (22) breaks towards the culminating zone (17);

wherein:

said water situated over the edge zone (15) and the wave progression zone (16) forms part of an aquatic environment (23) which, externally of the support (11;55) along the edge zone (15), comprises a region (25), hereinafter called upper outer aquatic region, situated higher than the edge zone (15) and a region (26), hereinafter called deep outer aquatic region, situated lower than the edge zone (15), the upper outer aquatic region (25) and the deep outer aquatic region (26) being horizontally contiguous;

the upper outer aquatic region (25) and the region (24) of the aquatic environment (23) situated over said edge zone (15) and said wave progression zone (16), hereinafter called inner aquatic region, are vertically contiguous;

the upper surface (14) of the support (11;55) further comprises a crest (30) and a depressed zone (31) which is depressed relative to the crest (30), which crest (30) is located between the culminating zone (17) and the depressed zone (31), the culminating zone (17) and the depressed zone (31) being configured such that when the wave generator (12) is in use, the water at the end of travel of the waves (22) gets past the crest (30) and falls into a volume (32) delimited by the depressed zone (31), hereinafter called reception volume of the support; and fluidic communication (27;57) situated below the upper surface (14) of the support (11;55) connects said deep outer aquatic region (26) to an opening (33,39;58) which is open to said reception volume (32) of the support.

2. A facility according to claim 1, wherein said support is a platform (11); said aquatic environment (23) comprises, under the platform (11), a region (27), hereinafter called underlying aquatic region, the deep outer aquatic region (26) and the underlying aquatic region (27) being vertically contiguous; and said opening (33, 39) that is open to the reception volume of the support (32) is open to the underlying aquatic region (27), said fluidic communication situated below the upper surface (14) of the support (11) being implemented by the underlying aquatic region (27).

3. A facility according to claim 2, wherein said platform (11) is a floating platform.

4. A facility according to claim 3, wherein said platform (11) comprises an opening (39) in which is disposed a pile (38) fastened on the bottom (35) of the underlying aquatic region (27), the platform (11) and the pile (38) being configured for the platform (11) to slide relative to the pile (38) when changes occur in the surface level of the aquatic environment (23).

5. A facility according to claim 4, wherein said path (21) of said movable member (20) is annular, said edge zone (15) is situated at the periphery of the support (11;55) and said culminating zone (17) is situated towards the center of the support (11;55).

6. A facility according to claim 3, wherein said path (21) of said movable member (20) is annular, said edge zone (15) is situated at the periphery of the support (11;55) and said culminating zone (17) is situated towards the center of the support (11;55).

7. A facility according to claim 2, wherein said path (21) of said movable member (20) is annular, said edge zone (15) is situated at the periphery of the support (11;55) and said culminating zone (17) is situated towards the center of the support (11;55).

8. A facility according to claim 1, wherein said support is a substrate (55) in which is provided at least one pipe (57) to perform said fluidic communication situated below the upper surface (14) of the support.

9. A facility according to claim 8, wherein said path (21) of said movable member (20) is annular, said edge zone (15) is situated at the periphery of the support (11;55) and said culminating zone (17) is situated towards the center of the support (11;55).

10. A facility according to claim 1, wherein said path (21) of said movable member (20) is annular, said edge zone (15) is situated at the periphery of the support (11;55) and said culminating zone (17) is situated towards the center of the support (11;55).

11. A facility according to claim 10, further comprising a groin (40) connected to said support (11), said groin (40) projecting upwardly from the wave progression zone (16) while extending crosswise of the inner aquatic region (24) from the culminating zone (17) towards the edge zone (15).

12. A facility according to claim 11, wherein said groin (40) has an upper surface (41) comprising a first lateral zone (42), a second lateral zone (43) situated on the opposite side to the first lateral zone (42) and an intermediate zone (44) extending from the first lateral zone (42) to the second lateral zone (43), said intermediate zone (44) comprising at least one crest (45, 46) that is emerged when the wave generator (12) is at rest.

13. A facility according to claim 12, wherein said intermediate zone (44) comprises a first crest (45) and a second crest (46), each of which is emerged when the wave generator (12) is at rest, and comprises a depressed zone (47) which is depressed relative to the first crest (45) and the second crest (46), the first crest (45) being located between the first lateral zone (42) and the depressed zone (47), the second crest (46) being located between the second lateral zone (43) and the depressed zone (47); the first crest (45), the second crest (46) and the depressed zone (47) being configured such that when the wave generator (12) is in use, the water at the end of travel of the waves (22) gets past the first crest (45) or the second crest (46) and falls into a volume (48) delimited by the depressed zone (47), hereinafter called reception volume of the groin;

said water situated over the edge zone (15) and the wave progression zone (16) forms part of an aquatic environment (23) which, externally of the support (11;55) along the edge zone (15), comprises a region (25), hereinafter called upper outer aquatic region, situated higher than the edge zone (15) and a region (26), hereinafter called deep outer aquatic region, situated lower than the edge zone (15), the upper outer aquatic region (25) and the deep outer aquatic region (26) being horizontally contiguous;

fluidic communication (24, 49) linking said reception volume of the groin (48) to said upper outer aquatic region (25) and/or to said deep outer aquatic region (26).

14. A facility according to claim 13, wherein the upper surface (14) of the support (11;55) further comprises a crest (30) and a depressed zone (31) which is depressed relative to the crest (30), which crest (30) is located between the culminating zone (17) and the depressed zone (31), the culminating zone (17) and the depressed zone (31) being configured such that when the wave generator (12) is in use, the water at the end of travel of the waves (22) gets past the crest (30) and falls into a volume (32) delimited by the depressed zone (31), hereinafter called reception volume of the support; and said reception volume (32) of the support and said reception volume (48) of the groin meet vertically.

15. An artificial wave facility for the practice of surfing, comprising:

a support (11;55) having an upper surface (14) comprising an edge zone (15), a wave progression zone (16) and a culminating zone (17), the wave progression zone (16) extending, in an upwards slope, from the edge zone (15) to the culminating zone (17);

water situated over said edge zone (15) and said wave progression zone (16);

an artificial wave generator (12) comprising at least one water driving member (20) movable over the edge zone (15) along a predetermined path (21), said wave generator (12) and said upper surface (14) of the support (11;55) being configured such that when the wave generator (12) is at rest the culminating zone (17) is emerged and when the wave generator (12) is in use, the movable member (20) is laterally followed by a wave (22) moving in the water towards the wave progression zone (16) in contact with which the generated wave (22) breaks towards the culminating zone (17);

wherein:

said water situated over the edge zone (15) and the wave progression zone (16) forms part of an aquatic environment (23) which, externally of the support (11;55) along the edge zone (15), comprises a region (25), hereinafter called upper outer aquatic region, situated higher than the edge zone (15) and a region (26), hereinafter called deep outer aquatic region, situated lower than the edge zone (15), the upper outer aquatic region (25) and the deep outer aquatic region (26) being horizontally contiguous;

the upper outer aquatic region (25) and the region (24) of the aquatic environment (23) situated over said edge zone (15) and said wave progression zone (16), hereinafter called inner aquatic region, are vertically contiguous;

said support is a platform (11) ; and said aquatic environment (23) comprises, under the platform (11), a region (27), hereinafter called underlying aquatic region, the deep outer aquatic region (26) and the underlying aquatic region (27) being vertically contiguous.

16. A facility according to claim 15, wherein said platform (11) is a floating platform.

17. A facility according to claim 16, wherein said path (21) of said movable member (20) is annular, said edge zone (15) is situated at the periphery of the support (11;55) and said culminating zone (17) is situated towards the center of the support (11;55).

18. A facility according to claim 15, wherein said path (21) of said movable member (20) is annular, said edge zone (15) is situated at the periphery of the support (11;55) and said culminating zone (17) is situated towards the center of the support (11;55).

19. An artificial wave facility for the practice of surfing, comprising:

a support (11;55) having an upper surface (14) comprising an edge zone (15), a wave progression zone (16) and a culminating zone (17), the wave progression zone (16) extending, in an upwards slope, from the edge zone (15) to the culminating zone (17);

water situated over said edge zone (15) and said wave progression zone (16);

an artificial wave generator (12) comprising at least one water driving member (20) movable over the edge zone (15) along a predetermined path (21), said wave generator (12) and said upper surface (14) of the support (11;55) being configured such that when the wave generator (12) is at rest the culminating zone (17) is emerged and when the wave generator (12) is in use, the movable member (20) is laterally followed by a wave (22) moving in the water towards the wave progression zone (16) in contact with which the generated wave (22) breaks towards the culminating zone (17); said path (21) of said movable member (20) being annular, said edge zone (15) being situated at the periphery of the support (11;55) and said culminating zone (17) being situated towards the center of the support (11;55);

wherein said facility further comprises a groin (40) connected to said support (11), said groin (40) projecting upwardly from the wave progression zone (16) while extending crosswise of the region (24) situated over said edge zone (15) and said wave progression zone (16) from the culminating zone (17) towards the edge zone (15).

20. A facility according to claim 19, wherein said groin (40) has an upper surface (41) comprising a first lateral zone (42), a second lateral zone (43) situated on the opposite side to the first lateral zone (42) and an intermediate zone (44) extending from the first lateral zone (42) to the second lateral zone (43), said intermediate zone (44) comprising at least one crest (45, 46) that is emerged when the wave generator (12) is at rest.

* * * * *